United States Patent [19]

Lambly et al.

[11] 3,934,935

[45] Jan. 27, 1976

[54] HYDRAULIC MINING OF OIL BEARING FORMATION

[75] Inventors: Charles A. R. Lambly, Alamo; Charles T. Draney, Hillsborough, both of Calif.

[73] Assignee: Bechtel International Corporation, San Francisco, Calif.

[22] Filed: Aug. 26, 1974

[21] Appl. No.: 500,796

[52] U.S. Cl. ..... 299/2; 299/16

[51] Int. Cl.[2] ..... E21C 45/00

[58] Field of Search ..... 299/2, 11, 17, 7, 8, 9, 299/6, 16; 175/213, 67; 239/206

[56] References Cited

UNITED STATES PATENTS

| | | | |
|---|---|---|---|
| 1,607,586 | 11/1926 | Claytor | 299/17 X |
| 1,856,836 | 5/1932 | Howell | 299/2 X |
| 1,935,643 | 11/1933 | Laughlin | 299/2 |
| 3,097,830 | 7/1963 | Love et al | 299/11 |
| 3,402,968 | 9/1968 | Fischer | 299/11 |
| 3,467,435 | 9/1969 | Mallander | 299/11 |
| 3,529,868 | 9/1970 | Hogg | 299/7 |
| 3,749,314 | 7/1973 | Robinson et al. | 239/206 |
| 3,797,590 | 3/1974 | Archibald et al. | 175/67 |

*Primary Examiner*—Frank L. Abbott
*Assistant Examiner*—Richard E. Favreau
*Attorney, Agent, or Firm*—Townsend and Townsend

[57] ABSTRACT

Method for recovering bitumen from oil or tar sand using jets of hot water and/or steam introduced into the sand via raises connected to underlying spaced aprt tunnels. The jets are arcuately moved horizontally in overlapping patterns to slurry the sand. Caverns are formed by caving the tar sand and removal of the slurry into which the over burden is permitted to cave forming there above a surface depression usable as a tailing pond. Cavities are formed by other jets which connect with the priorly formed cavities so there is a continuous backward movement of interconnecting cavities.

16 Claims, 6 Drawing Figures

HYDRAULIC MINING OF OIL BEARING FORMATION

BACKGROUND OF THE INVENTION

1. Field of the Invention

The continuing increase in demands for energy and the accelerated use of natural gas and petroleum has increased the interests in alternative sources of fossil fuels. Oil and tar sands, which are prevalent in Canada and the United States, as well as other parts of the world, could provide an increasingly large source of fossil fuel, if the major portion of the oil and tar sands could be mined economically and efficiently. About 90 percent of the known oil and tar sand deposits are present under such a large overburden of rock and soil, as to preclude strip mining. Therefore, at present, about 90 percent of the known oil and tar sands cannot be economically and efficiently mined.

DESCRIPTION OF THE PRIOR ART

U.S. Pat. Nos. 3,749,314 and 3,797,590 disclose a high pressure jet nozzle and its use in underground mining. U.S. Pat. No. 3,606,479 discloses the use of such high pressure nozzle in the slurry removal of mineral ore from a storage container, such as a ship. Also of interest is U.S. Pat. No. 1,935,643, which is concerned with the mining and treating of oil bearing sands.

SUMMARY OF THE INVENTION

Tar sand and other similar oil bearing formations are mined from below by establishing one, usually at least two tunnels, in the underlying stratum underneath the tar sand formation and drilling substantially a line of raises, bore holes, or channels (hereinafter referred to as channels) from the tunnels into the tar sand formation. Oscillating and/or rotating high pressure jet stream nozzles are introduced through the channels into the tar sand formation, so as to direct high pressure, high velocity streams of fluid, e.g. hot water, above the underlying stratum into the tar sand formation, forming a slurry of fluid, sand and bitumen. The jet streams are usually directed in horizontal planes but such planes could be inclined if deemed necessary or desirable.

The slurry flows downwardly, is gathered and directed through pipes, through the tunnel to a separation plant, which separates the bitumen from the sand and fluid, e.g. water.

The jets are spaced apart in a predetermined pattern at a distance somewhat less than twice their effective distance, so that the areas covered by the jet streams overlap to insure that tar sand pillars, which would support overlying formations of tar sand and overburden, are not left in the tar sand formation. As a cavity is created and enlarged in the tar sand formation, the tar sands above the cavity fall into the cavity in the path of the jet stream and are slurried. Each jet stream forms a large cavity interconnecting with adjacent cavities to form a large chamber. Successive rows of jet streams are initiated so that there is a continually receding chamber as the tar sands are eroded away. When the tar sand formation can no longer support the overlying formation above the chamber, the formations will cave into the chamber.

DESCRIPTION OF THE SPECIFIC EMBODIMENTS

Figure 1:
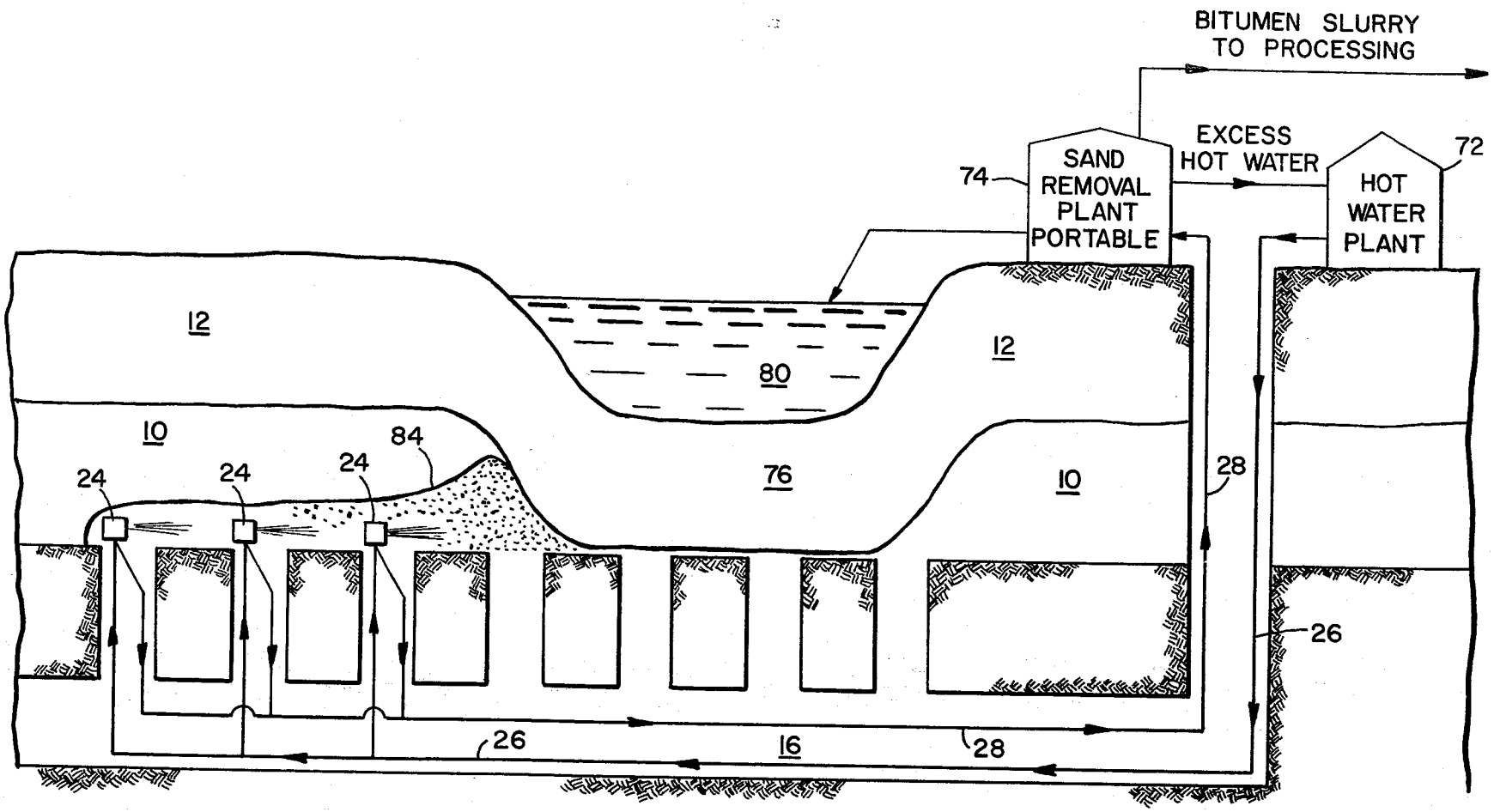
FIG. 1 is a diagrammatic elevation cross section of an intermediate stage in the process of this invention.

Tar sands and similar oil bearing formations are found between an overburden of rock and soil and an underlying stratum. The hydrocarbon in the tar sands is actually bitumen, a dense black vicous material. The predominant sand component is quartz in the form of rounded or subangular particles. A film of water wets the sand grains, and the wetted particles are covered by a film of bitumen that partially fills the void volume between them. Connate water fills the rest of the void volume, along with occasional small volumes of gas. The sand grains are packed to a void volume of about 35 percent, and this corresponds to a mixture of approximately 83 weight percent sand and 17 weight percent bitumen with water. By subjecting the bitumen coated sand and particles to a hot water or steam stream, a slurry can be formed, whereby the bitumen and sand is dispersed in the water, and can be readily transported. For the purposes of this invention, tar sands will be employed as illustrative of tar sands and similar oil bearing formations.

While less than 10 percent of the known tar sand deposits are covered by an overburden of small or moderate depth, which allows for strip mining, the major proportion (90 percent or more) of the known tar sand deposits are covered with overburdens of sufficiently great depth, as to make strip mining not feasible.

In accordance with the subject invention, a shaft or tunnel from the surface through substantial depths of overburden is provided from which one or a plurality of tunnels are introduced. The tunnels may be horizontal, inclined or declined depending on the formation. The tunnels are separated by a predetermined distance, in accordance with the effective distance of a high pressure jet stream, which is employed. The high pressure jet stream will be discussed subsequently. From the tunnels, spaced channels are bored upwardly into the tar sands, with the openings of the channels being in a predetermined pattern, conveniently aligned, so as to define a front. The tunnels are sufficiently below the oil bearing deposit to insure their structural integrity. The cross section of the tunnels are sufficient to allow for introduction of the necessary equipment and removal of the deposit material as a slurry.

The raises or channels are drilled upwardly, and are of sufficient size to allow for the introduction of the necessary equipment and the removal of the tar sand and water slurry through pipes. Since the channels are spaced apart, the equipment can be presented to the tar sand only at spaced locations along the same. To provide for greater flexibility in the placement of the equipment, slots can be formed in the underlying stratum instead of drilling the channels. While channels will hereinafter be described, the aforesaid slots are within the purview of the present invention.

The channel is bored upwardly from the tunnel into the tar sand, so that a high pressure, high velocity jet nozzle may be introduced above the underlying stratum and into the area occupied by the tar sands. Usually, the nozzle will be introduced, so as to provide a jet stream contiguous with the surface of the underlying stratum. However, depending upon the nature of the tar sand deposit or the nature of the tar sand formation, as well as the presence of unwanted (reject) materials consisting of clay, shales, siltstone, sandstone and lean oil sand, the position of the nozzle in the vertical direction may vary.

While various liquid or liquid compositions may be employed, conveniently hot water or steam, either separately or in combination, will be used for the liquid jet, with or without ancillary materials. Illustrative materials include emulsifiers or surfactants in amounts from about 0.001 to 1 weight percent, wetting agents, miscible and immiscible organic solvents, settling agents, and the like. While cold water may be employed, preferably the temperature of the water will generally be at least about 30°C, more usually at least about 60°C, and normally not exceed about 95°C, although superheated water and/or steam may be employed at temperatures substantially exceeding 100°C. The pressure of the water will generally be at least about 100 psi, and will generally not exceed about 2,000 psi, usually being in the range of about 150 to 500 psi, although higher pressures may be desirable for quick slurrying of the deposit formation.

The jet nozzle will be rotated in a plane, preferably a substantially horizontal plane; however, the plane could be inclined if deemed desirable or necessary. The rotation of each jet nozzle will be either with or without a superimposed oscillatory movement, such as in a range of approximately 10° to 180°. The jet nozzle may rotate 360° or first rotate 180° and then be turned to rotate the remaining 180°. Where the jets complete a circle, successive rows of jets will be separated by less than twice the effective distance of the jet stream, so that there is substantial overlap of their effective areas. In some instances, narrower arcs may be defined and different nozzles in the same row rotated through different arcs.

A substantial portion of the effective distance of the jet stream from adjacent nozzles will overlap, usually at least about 15 percent of the effective distance. Depending upon the particular nozzle, a high velocity, high pressure jet stream can be provided, which is effective for distances above about 150 feet. The spacing of the nozzles will therefore be about one per 200 feet in a particular row. That is, there will be substantial overlap of the effective area of the nozzles.

The substantially horizontal rotating movement of the nozzles has many advantages. Where water is directed continuously in a single direction, the water acts as a buffer against the impinging stream, reducing its effectiveness in eroding and slurrying the tar sand. Where the stream moves away by rotating and then returns to the same position, the water previously introduced has drained away, removing the dislocated tar sands, so that a fresh tar sand surface is exposed to the jet stream.

While any system, which provides a high velocity, high pressure jet stream in a horizontal direction can be employed, a system of particular interest is the subject matter of U.S. Pat. No. 3,749,314. The description of the high velocity, high pressure jet nozzle as part of a capsule is found in U.S. Pat. No. 3,797,590, which description is incorporated herein by reference.

As previously indicated, normally a small cavity, which can be expanded into a dome-shaped cavity, will be provided from the channel immediately about and above the impervious stratum. The jet in a capsule may then be introduced into the dome-shaped cavity. A conduit is provided through the tunnels and channel as a source of fluid, e.g. hot water, for each of the jets. In addition, a mechanism is provided for rotating the jet in a capsule. The jets are arranged in a convenient pattern depending on the particular tar sand formation to insure the substantially complete removal of the tar sands. The tar sands may be eroded in a relatively linear front, staggered front, curved front or combinations thereof. In one embodiment, the jet is rotated in about a 180° arc, so that a semi-circle is defined, with its straight side aligned with the straight sides of the semicircles defined by the other capsules, which are in alignment in a row normal to the tunnels.

Where the jet is to be maintained in a single position, the capsule may be grouted in place adjacent the impervious stratum. Alternatively, the channel may be bored up into the tar sand formation and the capsule moved periscopically in the vertical direction, so that tar sands in an upper portion or middle portion of the formation is eroded away.

In addition to the jet and the auxiliary equipment of the jet capsules, the tunnels and channels will be equipped with appropriate ventilation systems, insulated pumps, piping for carrying the slurry, and insulated slurry pumps to remove the tar sand and water slurry from the tunnel to appropriate settling tanks.

To initiate the process, a plurality of jet streams from capsules in a first row are directed toward the tar sand deposits. Usually, at least two, and more usually three or more jet streams are concurrently employed. A substantial portion of the effective area of the jet streams of adjacent capsules overlap. Also, the effective distance of succeeding rows of jet streams overlap the area covered by the immediately preceding row of jet streams. The jets move in an arc with the jets oscillating or simply rotating Therefore, the tar sand deposit between two jets will be completely eroded away by the action of the jet streams. As the jets rotate, a continually enlarged cavity will be formed in the path of the jet streams, with the water forming a slurry of the tar sand deposit. The slurry will flow by gravity into pipes in the channels and be moved by pumps to the surface for further processing.

With the cavity being continually enlarged, the tar sands above the cavity will begin to cave in. The caved-in tar sands will then be subjected to the force of the jet stream, become slurried and be removed through the pipes. As the process continues, the interconnection of the cavities being formed by each of the jet streams, forms a large chamber or cavern. Because of the overlapping of the areas covered by the jet stream, pillars of tar sands, which would otherwise support the overlying formations of tar sand and overburden are prevented, so that when a substantial proportion of the tar sand deposit has been removed, the weight of the overburden causes the remaining tar sand and As to cave into the cavern. As the tar sands are being eroded away by the primary line of jets, prior to substantial cave-in of the overburden, the next line of jets are activated, and the erosion of tar sands initiated. The effective distance of the second line of jet capsules overlaps the first line of jets, so that all of the tar sand between the two jets is subjected to the jet stream. By appropriate timing along successive lines of jets, one can create a cavity with a sloping roof. In this manner, the tar sand formation is continuously eroded away in a relatively even manner and the remaining tar sands and overburden cave in in a relatively continuous manner. In effect then, there is a continuously receding front of tar sands, with the overburden filling the space left by the removal of the tar sands. In this manner, efficiencies of 75 percent or greater are achieved in the removal of the available tar sands.

For further understanding of the invention, the drawings will now be considered.

FIGS. 1 to 4*a* are diagrammatic drawings to illustrate various stages of the mining process of the subject invention. As previously indicated, tar sand formations 10 are normally found between an overburden 12 and an underlying stratum 14. The tar sand or oil sand formations, which can be mined in accordance with the subject invention, are those which can be slurried by a high velocity jet stream of a liquid, such as hot water and/or steam. Tar sand formations tend to be reasonably friable, unconstituted and unconglomerated, and are held together by a pervasive viscous oil.

Figure 5:
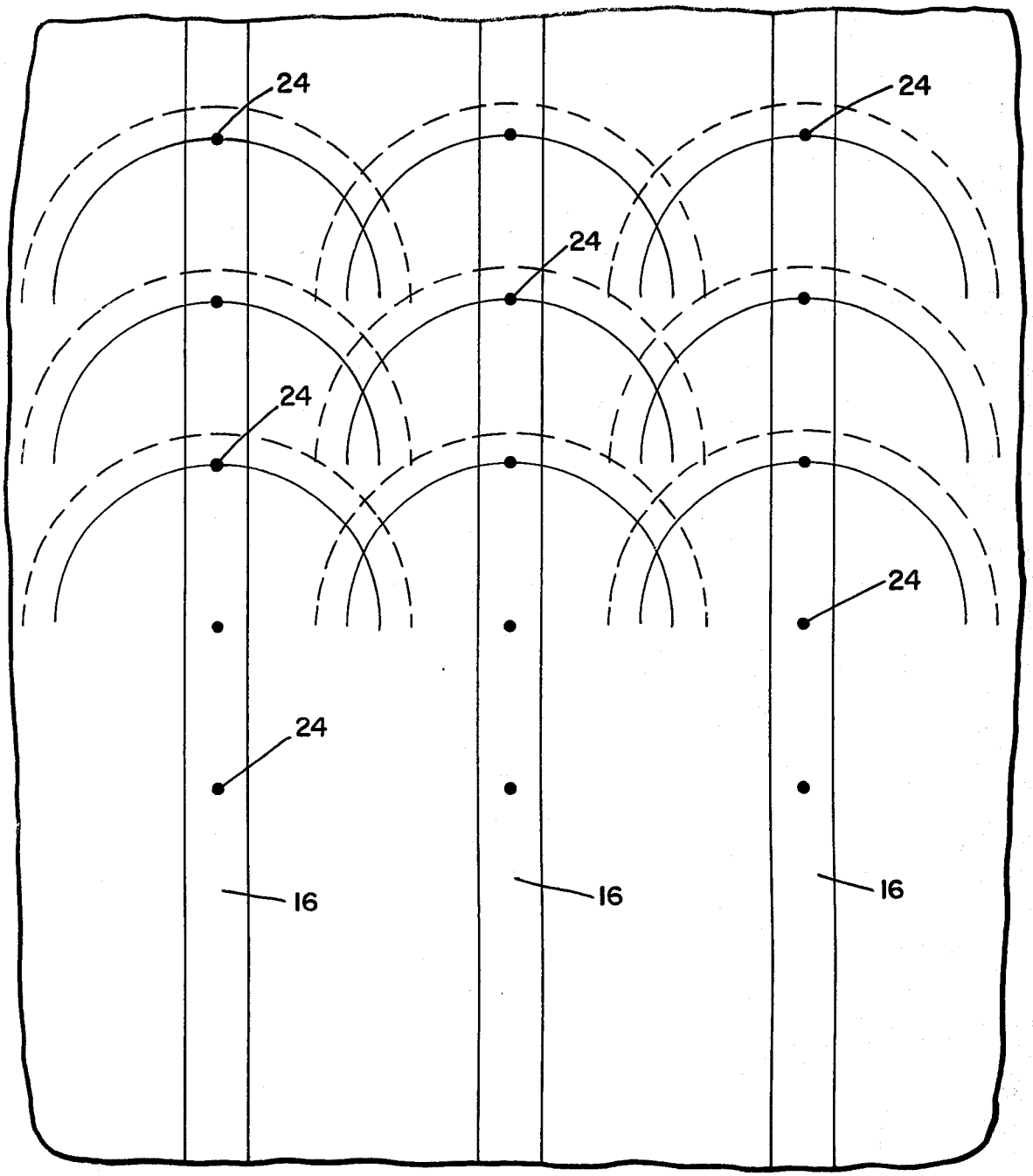
FIG. 5 is a diagrammatic plan view showing the relationship of the tunnels and effective ranges of the jet streams.

In performing the subject process, normally a utility shaft or tunnel is drilled from the surface into the underlying stratum 14, to provide access for the various conduits and equipment, which must be introduced. From the utility shaft, a tunnel grid comprised of a number of spaced tunnels 16, only one such grid being shown in FIG. 5, is drilled, which serves as the passageways for access to the tar sand deposits 10. From each tunnel 16, a plurality of vertical or substantially vertical channels 20, normally evenly spaced apart, are bored upwardly through underlying stratum 14 and into the tar sand formation 10. Such channels extend a sufficient distance into the tar sand formation, to allow for proper placement of the jet equipment connected by a conduit 26 to the necessary source of pressurized fluid, such as hot water or steam, and by a drainage pipe 28 to the necessary collection system. Each opening into the tar sand formation 10 can be expanded, if desired, to form a dome 22 for accommodation of such equipment.

Each jet comprises a capsule which has a nozzle 32 from which a high velocity liquid jet stream is directed into the tar sand formation 10 in a plane slightly above the underlying stratum surface 30. The jet stream may be directed horizontally or at a small acute angle to enhance the gravity flow of the slurry. Means (not shown), is provided for oscillating and/or turning the jet in the capsule 24 in an arc, so that the high velocity liquid stream impacts the tar sand deposit, disintegrating the deposit into a slurry. With the continuing action of the high velocity jet stream 34, the dome 22 will be expanded to a larger cavity 36.

Figure 3:
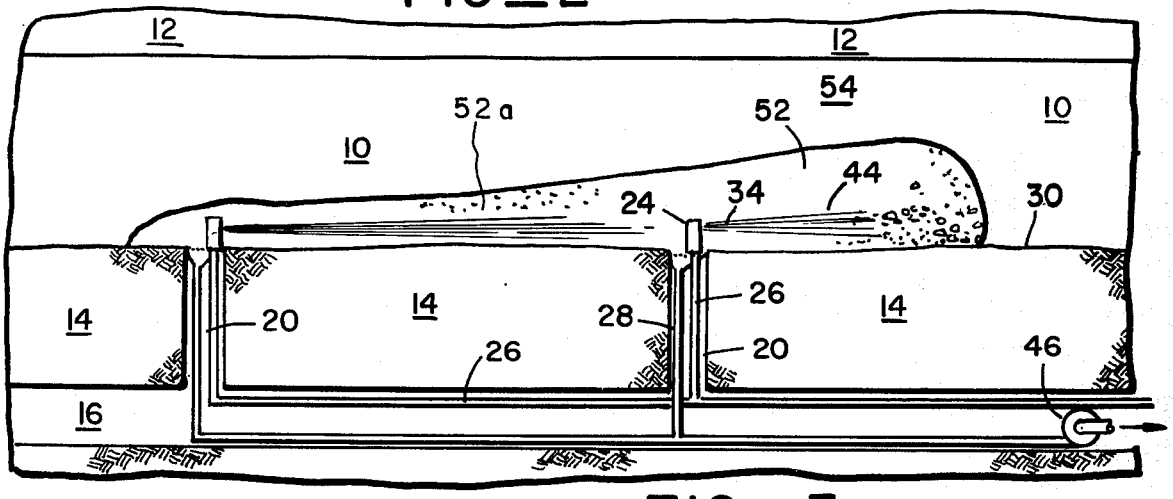

When the cavity reaches a sufficient size, the ceiling 40 of the cavity will cave into the cavity, enlarging the cavity, with the caved-in material becoming subject to the disintegrating force of the high velocity jet 34. The slurry 42 which is formed from the liquid jet stream 34, and the caved-in material 44, as indicated in FIG. 3, flows by gravity into pipe 28, and is then pumped by pump 46 to the surface for further processing. A grate 50 may be provided at the entrance to pipe 28 to prevent the introduction of large clumps of tar sand or barren materials.

As the walls and ceiling of the cavity cave in, cavity 36 will enlarge to a large area 52, where most of the tar sand deposit in the area of the capsule 24 has been removed as slurry. The adjacent cavities will become interconnected forming an extensive chamber or cavern. As the size of the cavity increases, the tar sand ceiling will become weakened and eventually will no longer be able to support itself and the overburden. Thus, the tar sand ceiling and overburden 12 will collapse into the cavity area 52, filling the latter as shown in FIG. 3. The jet will continue to slurry the loosened tar sands (denoted by the numeral 10*a*) underlying the caved overburden, until such tar sands have been removed in the form of a slurry. As this occurs, the caved overburden will continue to subside. Thereafter, the adjacent jets can be turned off and removed from the corresponding channels.

As cavity area 52 increases in size, the next row of jets 24, which will also be operative, will form an extension 52*a* (FIG. 3) to cavity area 52, so that both cavity area 52 and extension 52*a* will increase in size and connect with the adjoining row of cavities. Thus, two or even three or more rows of jet streams may operate simultaneously, eroding and removing the tar sand deposit in a uniform manner.

FIG. 1 diagrammatically shows the formation during the process of this invention, indicating the various auxiliary pieces of equipment. A hot water and steam plant 72 provides hot water or steam through conduit 26 to a plurality of jets 24, which are aligned successively along tunnel 16. As the jets rotate, the tar sand 10 is eroded away as a slurry and is carried through piping 28 to sand removal plant 74. The caved overburden 76 creates a depression, which can serve as a tailings pit 80. The sand removal plant 74 separates a portion of the cleaned sand from the slurry, and forwards the remaining sand, middlings and bitumen for further processing to a bitumen processing plant (not shown). Excess hot water is transferred to the hot water plant, and the clean sand tailing is transferred to the tailings pit 80. The warm water and sand serve as an insulation for the tar sands, providing some heat to the tar sands.

Figure 2:
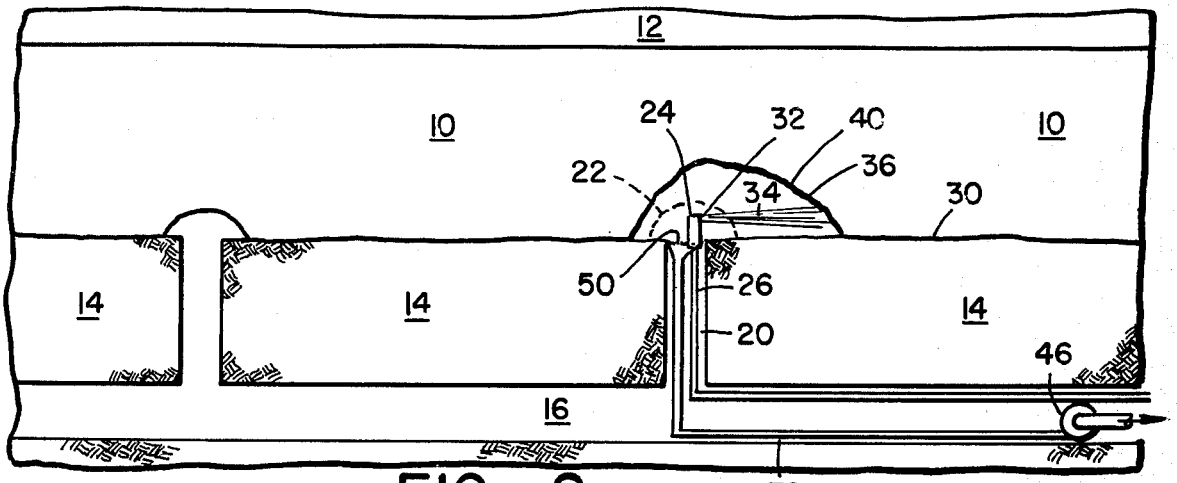
FIGS. 2 to 4*a* are diagrammatic elevational cross sections of tar sand formations at successive static stages as to one cavity during the process of this invention.
Figure 4:
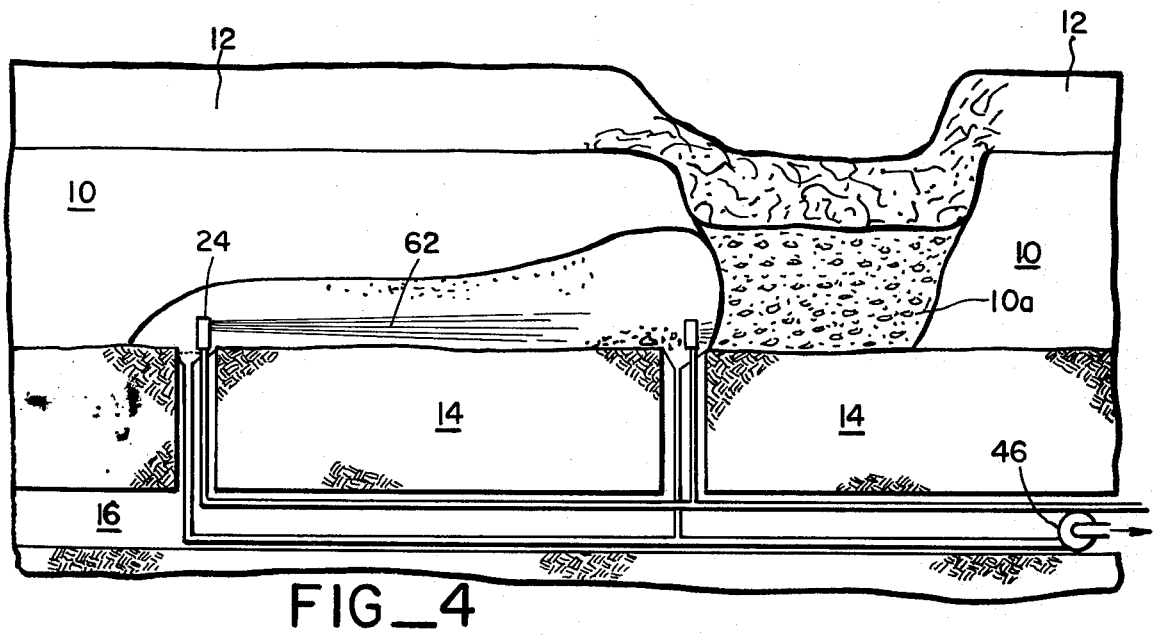
Figure 4A:
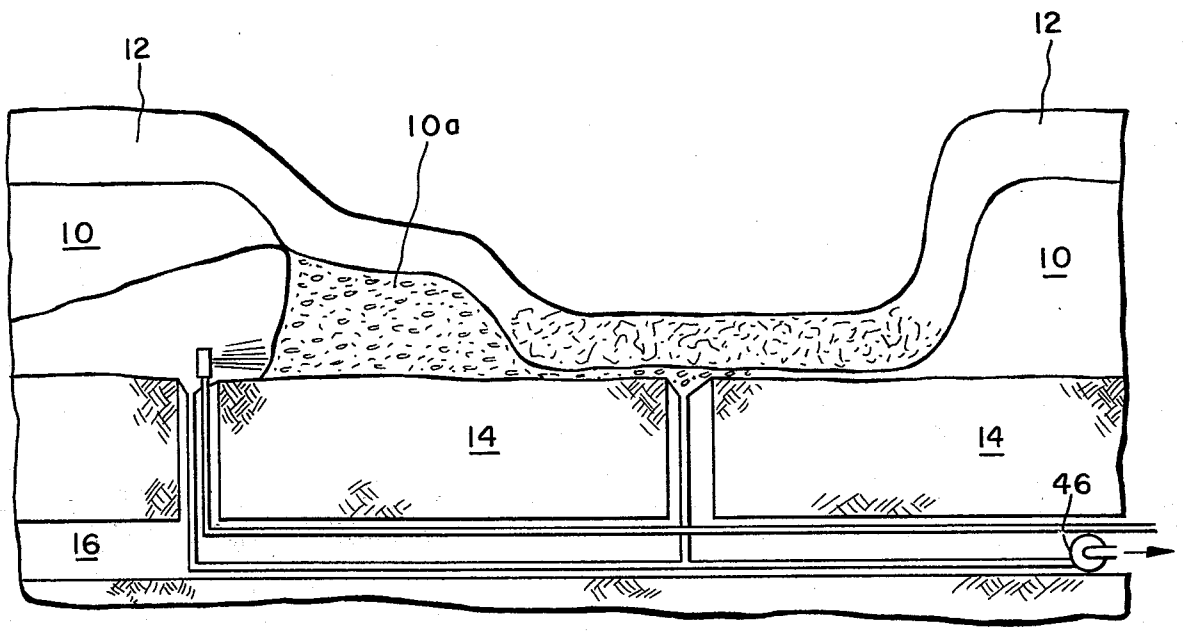

FIG. 2 shows the initial removal of tar sand from formation 10 and illustrates that the cavity or space in which nozzle 24 is disposed is relatively small in size. FIG. 3 shows that erosion has occurred in the bottom of formation 10 and that the cavity has increased in size sufficient to weaken portion 54 of the formation above cavity 52. FIG. 4 shows that portion 10*a* and the overburden thereabove have collapsed onto stratum 14, yet the adjacent nozzle 24 continues to direct a jet stream against the loosened material of portion 10*a*, so that it can be carried off as a slurry. FIG. 4*a* shows that the portion 10*a* of FIG. 4 has been completely removed, that the overburden previously thereabove has now subsided onto stratum 14, and that the next adjacent portion 10*a* of formation 10 and the corresponding overburden thereabove have collapsed. Thus, the weakening, collapsing and subsidence will continue as above in a progressive fashion.

By appropriate timing of the jet capsules along the tunnel, the caving-in of the tar sands into the cavity 52 can be controlled, so as to have a continuously receding ceiling 84 and chamber. As the tar sand formation caves and collapses and as the loosened tar sand is removed, the overburden 12 continues to subside, filling the cavity, and increasing the depression area, which can serve as a tailings pit 80, which is capable of receiving the continuing supply of sand tailings.

FIG. 5 diagrammatically shows how the jet stream arcs overlap where the jets are linearly aligned in rows normal to parallel tunnels and move in a 180° arc. The full effective force is felt at least the distance of the solid line, while substantial erosion can occur at the broken line or farther. Therefore, substantially all of the tar sand deposit is subjected to the erosive force of the jet stream. In this manner, the formation of pillars, which might act to support the overlying tar sand and overburden, is prevented, and all of the tar sands cave in and are subjected to the erosive force or slurrying force of the jet stream. Thus, one insures the continual caving-in of the overburden with the filling of the cavity and the formation of a tailing pit, which can receive the water and sand from the tar sand formation. A relatively uniform surface is achieved, which can be treated so as to recreate its previous ecological character.

The subject process has many advantages over prior art methods of mining tar sands. Current commercial mining methods involve stripping the overburden with bucket drag lines. This makes mining tar sands, which lie beneath more than 125 to 150 feet uneconomic. The subject method provides for economical mining of tar sand formations, which lie as much as 2,000 feet or more below the surface. The subject process is not affected by the depth of overburden. In the subject process, by drilling below the tar sand formation, one can ignore the depth of the overburden and avoid the high cost of removing the overburden. In addition, the high velocity liquid jet nozzle can be fixed in position, near the bottom of the tar sand formation, and by cave-in of the formation, high efficiency and removal of the tar sands from the formation is achieved. Also, gravity aids in removing the slurry of the tar sand to the gathering means for pumping to the surface.

The subject method also allows for minimum transfer of large amounts of barren rock and soil. As compared to current methods, which require the removal of the overburden and the tar sands from the formation and then require the dry tar sands to be transported considerable distances to a processing plant, where the tar sands are slurried in hot water to separate the sand from the bitumen, the subject method initially provides a slurry, which allows for easy transfer by pumping of large amounts of solid materials in slurries, and the slurry may then be introduced into a settling tank to provide the separation of clean sands from the bitumen and water slurries.

Although the foregoing invention has been described in some detail by way of illustration and example for purposes of clarity of understanding, it will be obvious that certain changes and modifications may be practiced within the scope of the appended claims.

What is claimed is:

1. A method of mining material from oil bearing formations, such as tar sands, wherein said formation is between an overburden of an overlying rock and soil formation and an underlying impervious stratum, by subjecting said formation to high velocity fluid jet streams capable of forming a slurry of said material; and wherein a plurality of spaced-apart tunnels are formed through said impervious stratum adjacent to and below said formation, which comprises:

boring upwardly from said tunnels into said formation, a plurality of spaced-apart rows of channels, wherein said rows are spaced apart at a distance less than the effective distance of said jet stream for forming slurry from said material;

from a first row of channels, directing into said formation material, high velocity rotating fluid jet streams to form a slurry of said formation material in the jet stream path, wherein the effective distance of adjacent jet streams overlap, so as to form a row of interconnecting cavities;

directing said jet streams toward material from areas adjacent to said cavities, so as to continually enlarge said interconnected row of cavities to define a chamber, while initiating rotating jet streams from the next adjacent row of channels, so as to form a receding chamber moving towards said next row of channels, until said formation material and said overburden above a portion of said chamber is no longer supported and caves into a portion of said chamber;

continuously removing slurry from said cavities for further processing; and repeating said process from successive rows of channels.

2. A method according to claim 1, wherein said jet streams are contiguous to said impervious stratum and said material adjacent to said cavities caves into said cavities into the paths of said jet streams and including the step of directing said jet streams toward the caved formation material lying under the caved overburden until the caved formation material has been slurried.

3. A method according to claim 1, wherein said oil bearing formation is tar sand.

4. A method according to claim 1, wherein said fluid is water.

5. A method according to claim 4, wherein said fluid is water at a temperature of at least 65°C or steam.

6. A method according to claim 4, wherein said slurry is partially processed by separating water and sand tailings from said slurry, and said caved overburden forms a pond at the surface of said overburden to receive said water and sand tailings.

7. A method according to claim 1, wherein at least three tunnels are employed and said overlap is at least 15 percent of the effective distance of said jet streams.

8. A method according to claim 7, wherein said jet streams are rotated in a 180° arc defining semi-circles, with the bases of said semi-circles of a row of jet streams in substantial alignment.

9. A method of mining tar sand, wherein said tar sand is between an overburden of an overlying rock and soil formation and an underlying impervious stratum, by subjecting said tar sand to high velocity jet streams of water or steam capable of forming a slurry of said tar sand; and wherein a plurality of spaced-apart tunnels are formed through said impervious stratum adjacent to and below said tar sand, which comprises:

boring upwardly from said tunnels into said tar sand, a plurality of spaced-apart rows of channels, and introducing through said channels into said tar sand, high velocity jet stream sources, wherein the distance between adjacent jet stream sources in successive rows is less than the distance for which said jet streams are effective in slurrying tar sand, from a first row of channels, directing into said tar sand, high velocity substantially horizontally rotating jet streams of water contiguous said impervious stratum to form a slurry of said tar sand in the jet stream path, wherein the area covered by adjacent jet streams overlap, so as to form a row of interconnecting cavities, and wherein tar sand adjacent to said cavities caves into said cavities;

directing said jet streams toward said caved-in tar sand, so as to slurry said caved-in tar sand and continually enlarge said interconnected row of cavities to define a chamber, while directing substantially horizontally rotating jet streams contiguous to said impervious stratum from the next adjacent row of channels, until said tar sand and said overburden overlying a portion of said chamber is no longer supported and caves into a portion of said chamber;

directing jet streams toward the caved tar sand lying under the caved overburden to slurry said caved tar sand;

continuously removing slurry from said cavities for further processing; and repeating said process from successive rows of channels.

10. A method according to claim 9, wherein said water is employed in the form of at least one of hot water or steam.

11. A method according to claim 9, wherein said jet streams of water rotate in an arc of not greater than 180°.

12. A method according to claim 11, wherein said jet streams rotate in a 180° arc defining semi-circles, with the bases of said semi-circles of a row of jet streams in substantial alignment.

13. A method according to claim 9, wherein said jet streams are directed from jet nozzles which define rows of parallel straight lines.

14. A method according to claim 13, wherein said tunnels are substantially parallel and said lines are substantially normal to said tunnels.

15. A method of mining material from oil bearing formations, such as tar sands, wherein said formation is between an overburden of an overlying rock and soil formation and an underlying impervious stratum, by subjecting said formation to high velocity fluid jet streams capable of forming a slurry of said material; and wherein at least one tunnel is formed through said impervious stratum adjacent to and below said formation, which comprises:

boring upwardly from said tunnel into said formation, a plurality of spaced-apart successive channels, wherein said channels are spaced apart at a distance less than twice the effective distance of said jet stream for forming slurry from said material;

from a first channel, directing into said formation material, a high velocity rotating fluid jet stream to form a slurry of said formation material in the jet stream path;

directing said jet stream toward material from areas adjacent to said cavity, so as to continually enlarge said cavity to define a chamber, while initiating a rotating jet stream from the next channel, so as to form a receding chamber moving towards said next channel, until said formation material and said overburden above a portion of said chamber is no longer supported and caves into a portion of said chamber;

continuously removing slurry from said cavities for further processing; and repeating said process from successive channels.

16. A method according to claim 15, wherein said fluid is water.

* * * * *